US005477906A

United States Patent [19]

Legge et al.

[11] Patent Number: 5,477,906

[45] Date of Patent: Dec. 26, 1995

[54] CASTING OF METAL OBJECTS

[75] Inventors: Rodney A. Legge, Woodend; John A. Eady, East Doncaster; Rodney E. Proposch, Applecross, all of Australia; Joseph R. Ponteri, Chicago, Ill.

[73] Assignee: Comalco Aluminum Limited, Victoria, Australia

[21] Appl. No.: 172,227

[22] Filed: Dec. 23, 1993

Related U.S. Application Data

[62] Division of Ser. No. 114,242, Sep. 1, 1993, Pat. No. 5,297, 611, which is a continuation of Ser. No. 786,866, Nov. 4, 1991, abandoned.

[30] Foreign Application Priority Data

Nov. 5, 1990 [AU] Australia ..... PK3198

[51] Int. Cl.[6] ..... B22C 9/08; B22D 15/00; B22D 27/04; B22D 30/00

[52] U.S. Cl. ..... 164/122.1; 164/125; 164/126; 164/130; 164/136

[58] Field of Search ..... 164/119, 130, 164/136, 122, 122.1, 125, 126, 127, 122

[56] References Cited

U.S. PATENT DOCUMENTS

| | | | |
|---|---|---|---|
| 451,578 | 5/1891 | Richards . | |
| 853,490 | 5/1970 | West . | |
| 1,747,223 | 2/1930 | Campbell . | |
| 1,850,477 | 3/1932 | Roth | 164/125 |
| 3,265,348 | 8/1966 | Sylvester . | |
| 3,774,668 | 11/1973 | Iten et al. . | |
| 3,863,704 | 2/1975 | Kahn | 164/136 X |
| 3,882,942 | 5/1975 | Rohatgi et al. . | |
| 3,929,184 | 12/1975 | Reuter et al. . | |
| 4,733,714 | 3/1988 | Smith . | |
| 4,875,518 | 10/1989 | Imura et al. | 164/119 |
| 4,993,473 | 2/1991 | Newcomb . | |
| 5,072,773 | 12/1991 | Ruff et al. . | |

FOREIGN PATENT DOCUMENTS

| | | | |
|---|---|---|---|
| 19788/34 | 10/1935 | Australia . | |
| 20848/70 | 4/1972 | Australia . | |
| 611853 | 10/1926 | France . | |
| 1100788 | 9/1955 | France . | |
| 352309 | 4/1922 | Germany . | |
| 477287 | 6/1929 | Germany . | |
| 529838 | 7/1931 | Germany . | |
| 680515 | 8/1939 | Germany . | |
| 2147678 | 4/1972 | Germany . | |
| 53-11830 | 2/1978 | Japan . | |
| 55-136556 | 10/1980 | Japan | 164/136 |

(List continued on next page.)

OTHER PUBLICATIONS

Low Pressure Sand Casting: Current Experience With a New Process, by R. A. Smith, P. S. A. Wilkins, Cosworth Research & Development Ltd. Worcester, England AFS Transactions, May 1986, pp. 785–792.

Lavington, M. H. "The Cosworth Process–a new concept in aluminium alloy casting production", in *Metals and Materials,* Nov. 1986, pp. 713–719.

*Primary Examiner*—J. Reed Batten, Jr.

*Attorney, Agent, or Firm*—Nikaido, Marmelstein, Murray & Oram

[57] ABSTRACT

A mould assembly comprising mould segments of generally non-thermally conductive material which define a mould cavity is upwardly filled with liquid metal through at least one in-gate. A thermal extraction member of a high thermally conductive material contacts a portion of the mould cavity through which heat is extracted rapidly to establish positive thermal gradients in the casting and thereby promote directional solidification. The mould assembly is also provided with a seal to selectively isolate the mould assembly from the liquid metal source to allow the mould assembly to be removed from the casting station and transferred to the cooling station, providing a more efficient use of the casting station. In addition, once a shell has solidified then the mould segments and metal contained therein can be transferred to the cooling station.

47 Claims, 7 Drawing Sheets

FOREIGN PATENT DOCUMENTS

| | | | |
|---|---|---|---|
| 59-44365 | 10/1984 | Japan | 164/122 |
| 61-23565 | 2/1986 | Japan | 164/119 |
| 64-53758 | 3/1989 | Japan | 164/122.1 |
| 10-113164 | 5/1989 | Japan | 164/122.1 |
| 2-192872 | 7/1990 | Japan | 164/119 |
| 520598 | 4/1940 | United Kingdom . | |
| 1028736 | 5/1966 | United Kingdom . | |
| 2187984 | 9/1987 | United Kingdom . | |

CASTING OF METAL OBJECTS

This is a division of application Ser. No. 08/114,242, filed Sep. 1, 1993, and now U.S. Pat. No. 5,297,611, which is a continuation of application Ser. No. 07/786,866, filed Nov. 4, 1991, and now abandoned.

FIELD OF THE INVENTION

This invention relates to the production of cast metal objects.

BACKGROUND OF THE INVENTION

A known method of producing a metal casting, generally termed gravity casting, involves supplying metal to a mould cavity via a ladle or similar device through a running system with the metal entry point situated at or above the top of the mould cavity. In this casting method all the metal entering the mould cavity is subjected to some turbulence. Hence turbulence associated defects can often be a problem in castings produced by this method. These defects generally take the form of oxide inclusions and entrapped gas porosity, but may also include excessive mould erosion and the development of hot spots in the moulds.

The above disadvantage of gravity casting can be overcome, at least to some extent, by filling the mould through one or more in-gates below the top of the mould cavity from a source below the mould via a mechanism which allows complete filling of the mould. By doing this the force of gravity acts against the general upward flow of metal, helping to eliminate any turbulence caused by free falling liquid metal.

This method is generally termed low pressure casting and one known form of this method involves filling a metal mould via in-gates at the bottom of the mould cavity from a liquid metal source located beneath the mould. The metal source is usually contained in a pressure vessel and by increasing the pressure in the vessel, metal is pumped into the mould. A disadvantage of this method of casting is that the direction of solidification, which must always be towards a source of liquid feed metal, is from the coldest liquid metal at the top of the mould towards the hot test metal at the bottom. Natural convection within the mould, however, attempts to move the hot metal to the top of the mould and hence opposes the direction of solidification in the mould. This reduces directional solidification within the mould and problems can often be encountered in obtaining castings free from shrinkage porosity which occurs when sections of metal solidify within the mould and are not fed by the supply of liquid metal.

One method of overcoming the natural convection within the metal moulds and forcing solidification towards the feed metal at the bottom of the mould is to use channels within the mould which carry some form of cooling medium. These cooling channels are generally carried within the upper portion of the mould and force solidification to proceed down towards the feed metal at the bottom of the mould.

A major disadvantage of low pressure casting, however, is that the mould must stay connected to the metal source for a sufficient time for the casting in the mould to solidify or at least to become self-supporting. Therefore, for high rates of productivity, multiple casting stations and sets of expensive moulds are necessary, A second known variation of the low pressure casting method involves filling a sand mould via in-gates at the bottom of the mould from a metal source located beneath the bottom of the mould. In a further variation of this method a small secondary metal source can be incorporated in the mould cavity itself. By using light weight disposable sand moulds and Incorporating the secondary metal source, the mould can be rotated and then disconnected from the primary metal source. The casting is allowed to solidify elsewhere whilst being fed from the secondary metal source. This method allows the casting operation to take place independent of the time taken for the casting to solidify, thus greatly improving the productivity of the casting station.

A major disadvantage of simple sand moulds, however, is the low thermal gradients that are formed within the liquid metal in the moulds, especially when compared with those formed in metal moulds. With low thermal gradients, large areas of only partially solidified metal can develop ahead of the advancing solidification from and it is through these areas that liquid metal must be fed. This can often prove impossible and dispersed shrinkage porosity can result. The extent of this partially solidified zone is also alloy dependent and with lower thermal gradients there will be a smaller range of alloys that can be easily cast to produce a sound component.

Other disadvantages associated with conventional sand mould casting Include the slow solidification rates that are associated with sand casting resulting in coarse microstructures, especially when compared with the structures obtained in metal moulds. The microstructure of a casting is extremely important when considering mechanical properties, with finer microstructures leading to improvements in the entire range of mechanical properties.

Furthermore, the design of the feeding system for providing metal to the mould during solidification is, in part, dependent on the solidification time of the article being cast, since the feeding system must freeze last in the solidification process. If solidification times for the article being cast can be significantly reduced, the volume of metal required in the feeding system can be decreased correspondingly with potentially significant increases in casting yields.

In conventional sand moulds, thermally conductive inserts, called "chills", are often used. However, such chills cannot provide the benefits of the present invention. Chills provide only local and temporary directional solidification as they are placed in discrete sections of the mould and only provide heat extraction until the chill approaches the temperature of the solidifying metal. The mould combination and the resultant prolonged heat extraction achieved by the present invention have not been used before and represent an innovative and significant advance in mould design for the casting of aluminum alloys and other metals.

SUMMARY AND OBJECT OF THE INVENTION

It is an object of the present invention to provide a new and innovative method and apparatus for making a casting which overcomes many of the disadvantages of the previous methods of casting.

The invention therefore provides a mould assembly for the production of metal castings comprising mould segments defining a mould cavity for receiving liquid metal from a liquid metal source through at least one In-gate below the top of the mould cavity which allows quiescent filling of the mould assembly, said mould assembly having a thermal extraction number comprising at least one large surface area region of a high thermally conductive material positioned to cause rapid and positive extraction of heat from the solidifying casting in the mould cavity to establish and maintain positive thermal gradients in said casting.

Throughout the specification, the term thermal extraction member is intended to relate to a section of the mould assembly having a high thermal conductivity which can be brought into contact with an external heat sink to extract heat from the casting.

The remainder of the mould assembly is preferably formed from relatively non-thermally conducting particulate material. Quiescent filling of the mould assembly is preferably achieved by providing an in-gate which allows liquid metal to enter the mould cavity such that turbulence associated with free falling of liquid metal into the mould cavity is minimised or completely eliminated.

The use of substantial thermal conductive regions in the mould assembly, preferably in conjunction with an external heat transfer medium is a key feature of the invention as it provides a new and innovative means for rapidly and continuously removing heat from the solidifying melt to thereby develop in the solidifying melt the strong thermal gradients necessary to achieve directional solidification through the casting. A large thermal extraction member with external cooling has not been used previously in the sand casting of metal and especially aluminium components.

The external heat transfer medium may comprise some form of heat sink applied to the thermal extraction member of the mould assembly to further enhance the removal of heat from the solidifying melt in the mould.

In a preferred form, the mould assembly is provided with a means for sealing the mould cavity to allow the mould to be disconnected from the molten metal source while a substantial proportion of the metal in the mould cavity is liquid. The sealing of the mould can be achieved by various means including mechanical sliding plates, electromagnetic valves, or by freezing a short section of consumable runner and preferably occurs when the mould is full.

There is further provided a method of producing a casting by transferring molten metal from a molten metal source into the mould assembly according to the above definition, sealing the mould and isolating it from the metal source, and transferring at least the mould segments and the metal contained therein to a cooling station. During the transfer to the cooling station, the mould may be reoriented by inverting the mould assembly to assist feeding of the casting and to allow application of an external heat transfer medium or heat sink for the rapid removal of heat from the metal in the mould cavity.

The method of casting in accordance with the invention is referred to as improved low pressure casting (ILP).

In one preferred form of the invention the thermal extraction member or high thermally conducting region(s) is located at the bottom of the mould. Upon filling, the mould/assembly is quickly sealed and transferred to the cooling station where heat is rapidly and continuously removed from the heat conducting material. By rapidly removing heat from the heat conducting material, preferably via an external heat transfer medium, very positive directional solidification is established from the bottom of the mould towards feeders located at the top of the mould, thus promoting a sound casting. Higher solidification rates and thermal gradients are also obtained leading, respectively, to finer microstructures and the ability to cast a wider range of alloys. Also, by sealing the mould and rapidly removing it from the casting station, maximum usage of the casting facilities is achieved and high productivities are possible.

To allow rapid transfer of the mould to the cooling station in its appropriate configuration it is preferable that the mould be isolated from the molten metal source as soon as the mould cavity is full.

In another preferred form of the invention, the mould cavity is sealed from the molten metal source and heat is extracted from the thermal extraction member to form a self-supporting shell of solid metal prior to transfer of the mould segments and metal to the cooling station. The thermal extraction member would preferably remain at the casting station and the mould segments for the subsequent castings indexed onto the thermal extraction member at the casting station.

The foregoing and other features objects and advantages of the present invention become more apparent from the following description of the preferred embodiments and accompanying drawings.

BRIEF DESCRIPTION OF THE DRAWINGS

FIG. 3(*b*) is the view as shown in FIG. 3(*a*) with one possible type of sealing mechanism: a sliding plate in closed position;

FIG. 4(*b*) is a sectional view through line A—A in FIG. 4(*a*);

FIG. 5(*b*) is a sectional view through line B—B in FIG. 5(*a*);

FIG. 8(*b*) is a schematic sectional view of a casting made in a cylindrical mould with positive heat extraction;

FIG. 9(*b*) is a temperature versus time cooling curve for a casting made in accordance with the invention.

DETAILED DESCRIPTION OF THE DRAWINGS

Figure 1:
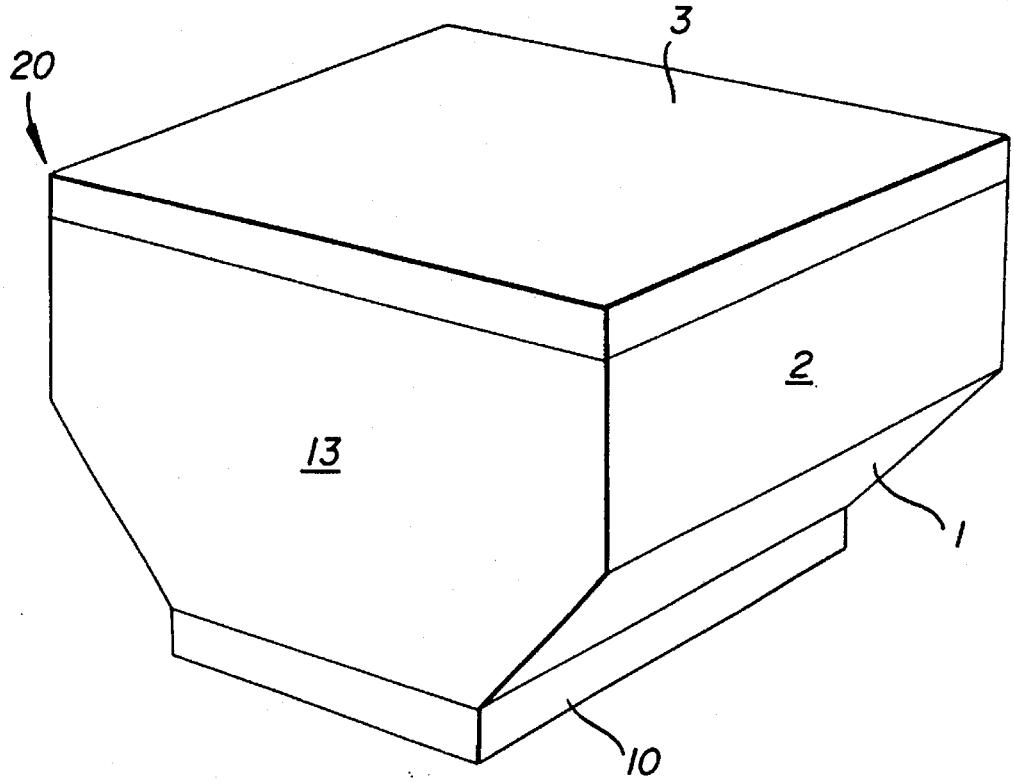
FIG. 1 is a perspective view of an embodiment of the invention.

In FIG. 1, a mould assembly is shown having a thermal extraction member or high thermally conducting plate 1, side and end elements 2, 13 respectively and a cope 3 sitting on a base 10. A sealing mechanism (not shown) for the mould is contained within the base 10 and may take any suitable form, such as those discussed further below.

Figure 2:
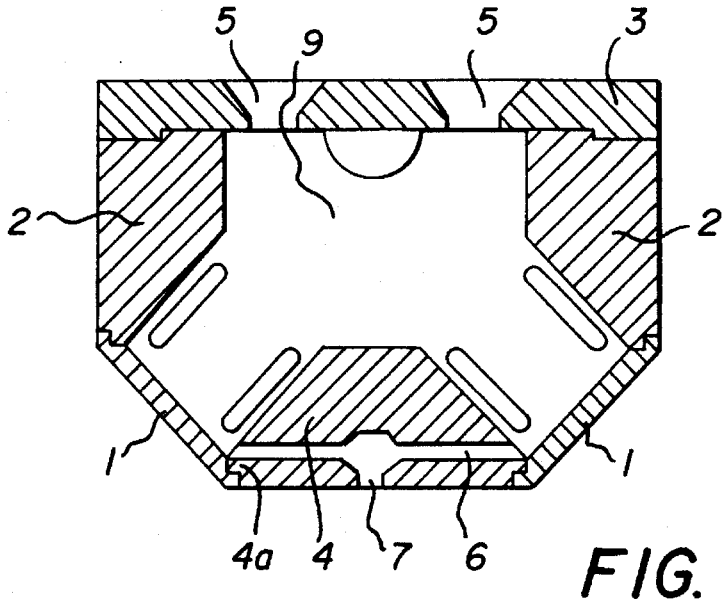
FIG. 2 is a sectional view of the invention as shown in FIG. 1.

FIG. 2 shows the internal relationship of the mould components to cast a V-configuration engine block within a mould cavity 9. The thermal extraction member is made from a high thermally conductive metal such as aluminium, copper or steel. The selection of material for the plate will depend on the temperature of the molten alloy being cast and the thickness of the thermal extraction member will be selected according to the conductivity properties of the material used to provide a desired cooling rate in the casting.

The mould cavity 9 within which the casting solidifies is defined by mould segments 2, 3, 4 and 13.

The cope 3 contains the secondary metal supply or feeding system 5 for the casting in cavity 9. The feeding system 5 may be any system known in the foundry art suitable for the top feeding of the casting. The feeding system 5 allows molten metal to enter the mould cavity to compensate for shrinkage as the casting solidifies.

The top deck element 4 and drag 4a together contain the running or distribution system 6 and metal inlet aperture 7 for the casting within the mould cavity 9. The running system for the mould assembly shown in FIG. 2 may be any system known in the foundry art which is suitable for feeding the bottom part of the mould through possibly even the side and end sections 2 and 13.

The metal delivery system (not shown) to the mould comprises known low pressure metal transfer technology such as gas pressurisation or a suitable pump which transfers liquid metal from a source to in-gates 6 of the mould so that an even flow of metal is provided. However, depending on the shape of the cavity or the level of metal in the cavity, it may be desirable for the metal to flow through certain in-gates to a greater or lesser extent.

The components of the mould assembly apart from the thermal extraction member, are generally, but not necessarily, composed of particulate material. Such particulate moulding material may be at least one of a variety of moulding sands including silica, zircon, olivine, chromite, chamotte or quartz or may even be a synthetic material.

Figure 3A:
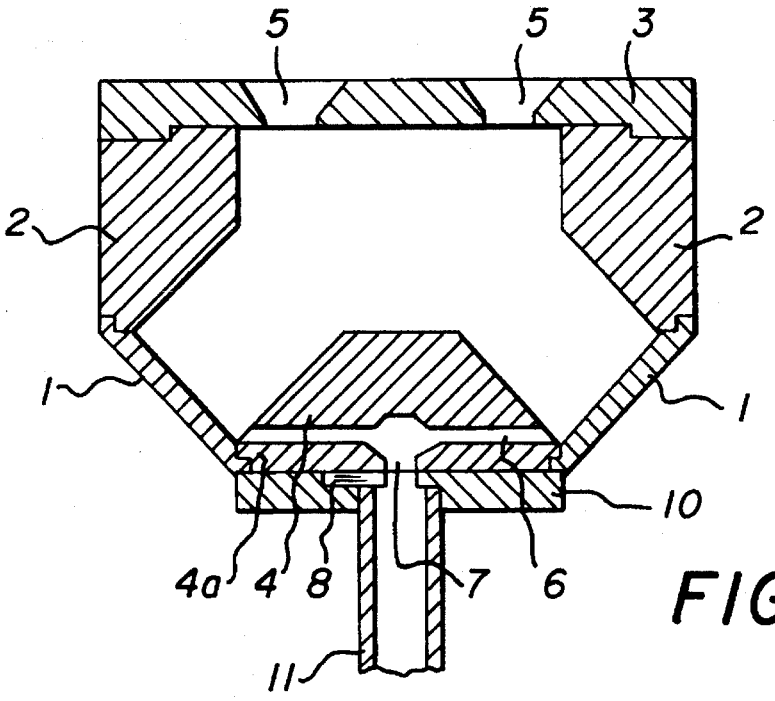
FIG. 3(*a*) is a sectional view of the embodiment of FIG. 1 connected to a metal delivery system.
Figure 3B:
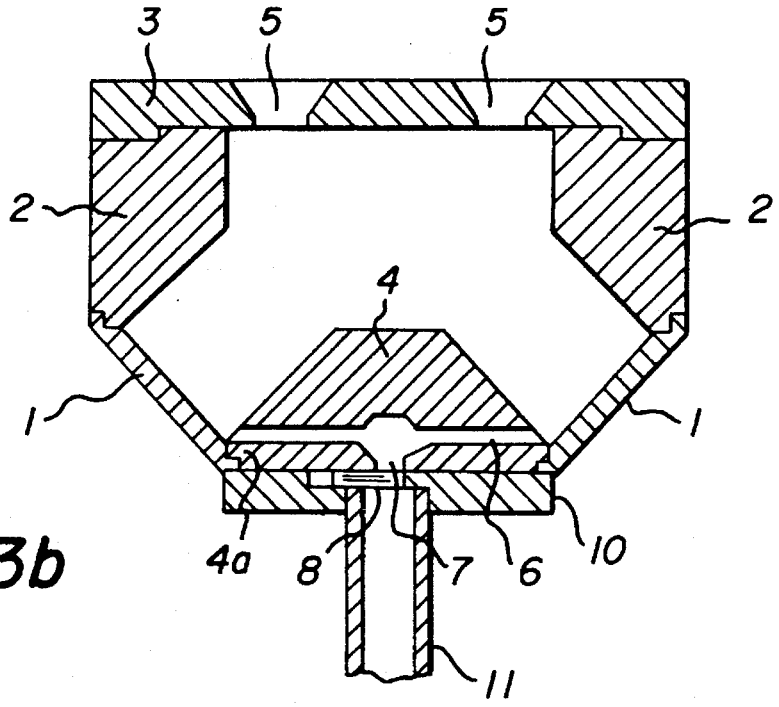

In FIGS. 3(*a*) and 3(*b*), the mould assembly sits on a base plate or casting plate 10. The sealing mechanism 8 is located within the base plate 10 and co-operates with insulated riser tube or launder system 11 to deliver liquid metal to the mould.

FIG. 3(*a*) shows the sealing mechanism in the open position allowing metal to flow into the mould and in FIG. 3(*b*) the sealing mechanism 8 is in the closed position.

After the mould cavity is sealed the mould assembly is transferred to a cooling station and oriented so that the thermal extraction member is able to be positively cooled by an external heat transfer medium or heat sink and molten metal enters the mould cavity from the feeding system. The external heat transfer medium is preferably an air or mist stream but a liquid transfer medium or contact with a heat exchange surface may be used.

Figure 4A:
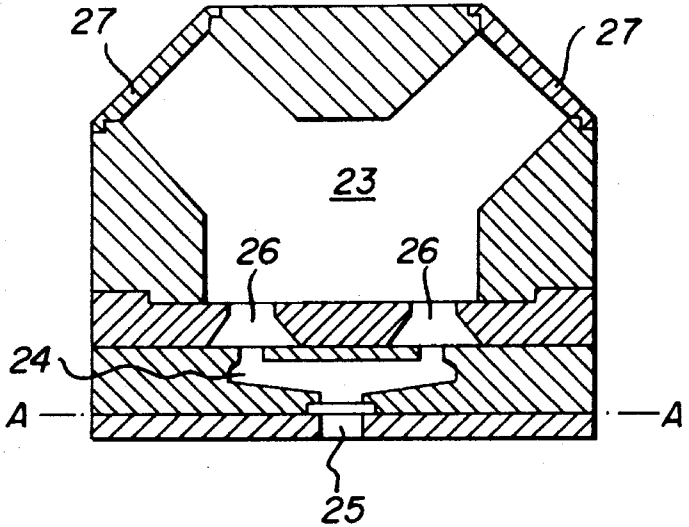
FIG. 4(*a*) is a sectional view of the mould assembly with the sliding plate sealing mechanism open.
Figure 4B:
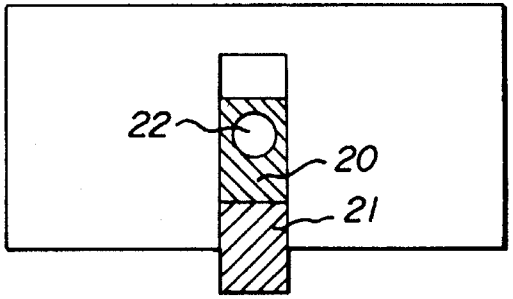

FIGS. 4(*a*), 4(*b*), 5(*a*) and 5(*b*) illustrate an embodiment of the invention with a sealing mechanism comprising a sealing plate 20 slidably retained within a cavity 28. The sealing plate 20 has an opening 22 positioned below the running system 24 for the casting which allows passage of liquid metal through the plate into the mould cavity. The sealing plate 20 abuts against a metal slide plate 21 which extends beyond the boundary of the mould assembly as shown in FIG. 4(b). In a preferred form the metal plate is attached to the rod of an actuator (not shown).

Figure 5A:
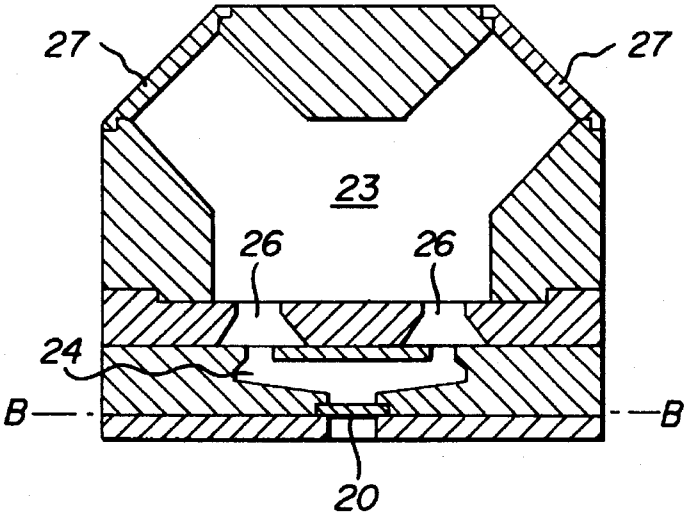
FIG. 5(*a*) is a sectional view of the mould assembly of FIG. 4(*a*) with the sliding plate sealing mechanism closed.
Figure 5B:
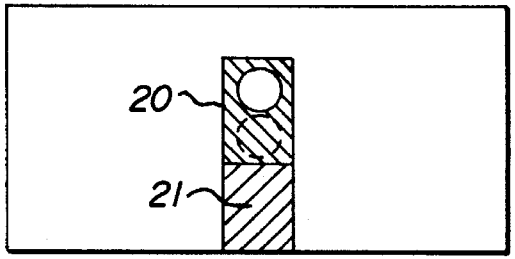

The mould assembly is shown with the thermal extraction member on the upper surfaces of the mould segments and the running system 24 includes a secondary metal supply cavity 26 communicating with the mould cavity 23. Once the mould cavity is full of liquid metal the slide plate 21 is moved across such that the opening 22 in sealing plate 20 is out of alignment with the riser tube 25 and the sealing plate closes off the metal inlet thereby sealing the mould cavity (FIG. 5(*b*)).

The sealing plate is preferably made from foundry sand or the like to allow it to be reclaimed with other particulate sections of the mould assembly after use. The sealing plate may also be made from steel or ceramic or any other suitable material. Alternatively, the sealing means may be an electromagnetic type wherein an electromagnetic field is used to seal or shift the metal flow into the mould or it may be a thermal sealing type wherein the inlet is rapidly frozen to provide a seal.

Figure 6:
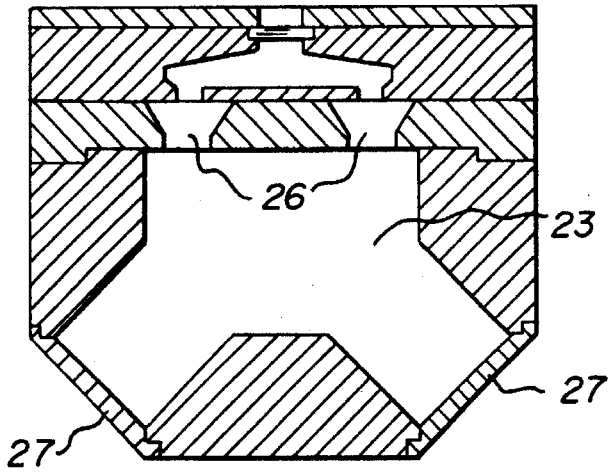
FIG. 6 is a sectional view of the reorientation mould assembly at the cooling station of the embodiment shown in FIGS. 5(*a*) and 5(*b*).

For the embodiment shown In FIGS. 4(*a*)–5(*b*) the mould assembly is inverted and positioned at the cooling station as shown in FIG. 6. The thermal extraction member 27 which is below the mould cavity 23 is contacted with the external heat transfer medium or heat sink. The secondary metal supply in cavity 26 is now above the mould cavity 23 so that as the casting solidifies molten metal enters the mould cavity from the secondary metal supply cavity 26 to compensate for the resultant shrinkage.

In an alternative embodiment of the invention the thermal extraction member is contacted with an external heat transfer medium or heat sink prior to the mould segments and the liquid metal in the mould cavity leaving the casting station. In this embodiment sufficient heat is removed by the thermal extraction member to form a thin self supporting shell of metal adjacent the thermal extraction member. The mould segments and liquid metal within the mould cavity are then separated from the thermal extraction member and removed to a cooling station.

The mould segments and melt may be reoriented prior to positioning at the cooling station whereupon external heat transfer medium or heat sink is applied to the solidified regions of the castings corresponding to the thermal extraction member to complete the solidification of the casting.

In this alternative embodiment, the thermal extraction member remains at the casting station and the new mould segments are indexed onto the thermal extraction member prior to commencement of the next casting operation.

Solidification of castings always proceeds along positive temperature gradients (i.e. from colder to hotter regions) and the solidification rate will increase as the temperature gradient increases.

The provision of the thermal extraction member provides for more rapid cooling and solidification of the casting. This gives the casting a generally preferred finer microstructure than castings normally produced from full sand moulds. Furthermore, by providing positive cooling to the mould assembly a larger temperature gradient is set up within the mould cavity providing for more definite directional solidification. This directional solidification is from the heat conducting plates at the bottom of the mould towards the feeders at the top of the mould thus promoting a sound casting.

To have the necessary macro effect on the solidifying melt in accordance with the invention the thermal extraction members must be sufficiently large to influence the thermal gradient and hence the direction of solidification In the whole melt. Small chill surfaces do not influence the whole melt and provide only very localised directional solidification, whereas the large thermal extraction members used in the mould assembly of the present invention influence the direction of solidification through the casting, The cooling effect of the thermal extraction member can be enhanced by applying secondary cooling to the thermal extraction member at the cooling station.

To enhance the extraction of heat from the thermal extraction member two further embodiments of the thermal extraction member will now be described. The first is a thermal extraction member with an increased surface area (cooling fins) on the external surface which is subjected to forced air cooling after casting. The second has a channel machined through the thermal extraction member which allows the thermal extraction member to be water cooled. The air cooled option is the easier to incorporate into a production process, while the water cooling provides the greater cooling to the extraction member.

Figure 7:
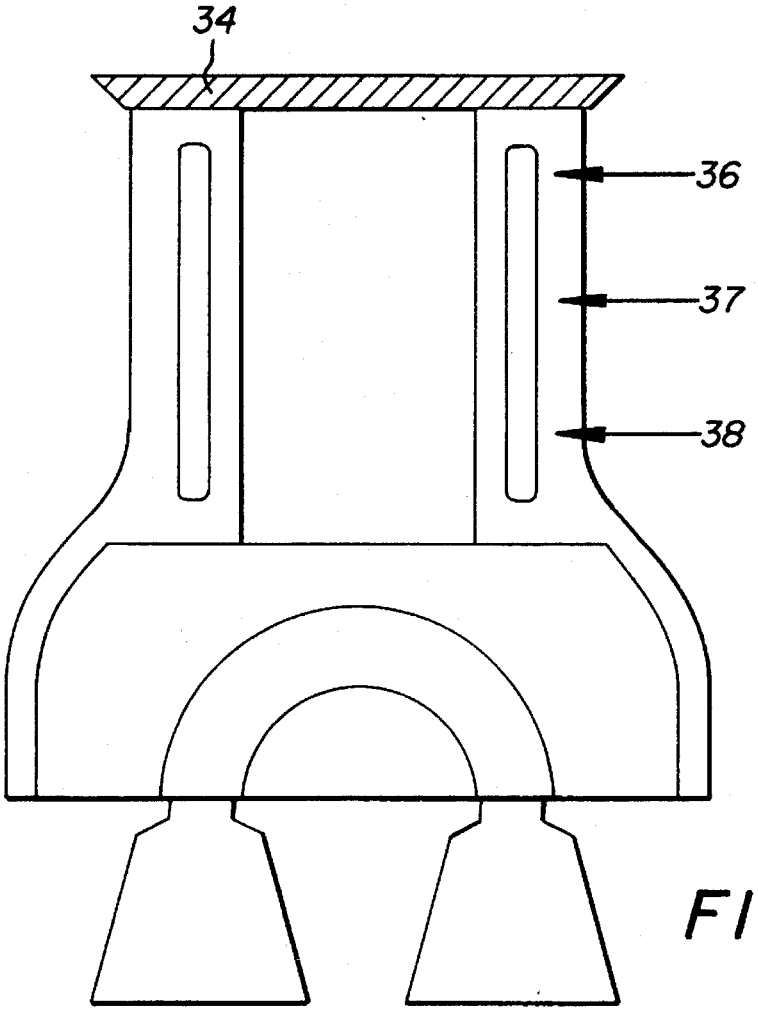
FIG. 7 is the casting shape used in the Examples.

For the following examples the test casting used was a simple single cylinder mock engine block (as shown in FIG. 7) which contained an internal water jacket core and oil gallery core. The casting (nett) volume was about 4000 $cm^3$ and the swept area of the thermal extraction member was 370 $cm^2$. The actual contact area of the thermal extraction member with the casting was 110 $cm^2$ and the average thickness of the thermal extraction member about 6.5 cm. The nominal wall thickness of the casting was 10 mm so that the thin thermocouples used to monitor temperatures in the casting would not have any significant effect on solidification. If more conventional wall thicknesses had been used (3–5 mm), the volume of even small thermocouples may have had an effect on the solidification of the casting.

Cooling curves as defined by thermocouple traces were used as the main means of determining the effects of the thermal extraction members on the solidification of the castings. The positions of the thermocouples shown as top 36 middle 37 and bottom 38 and thermal extraction members 34 (when used) In the castings are shown in FIG. 7. All thermocouples used were of the chromel-alumel (K Type) type and were enclosed in 1.6 mm diameter stainless steel sheaths.

EXAMPLE 1

Figure 8A:
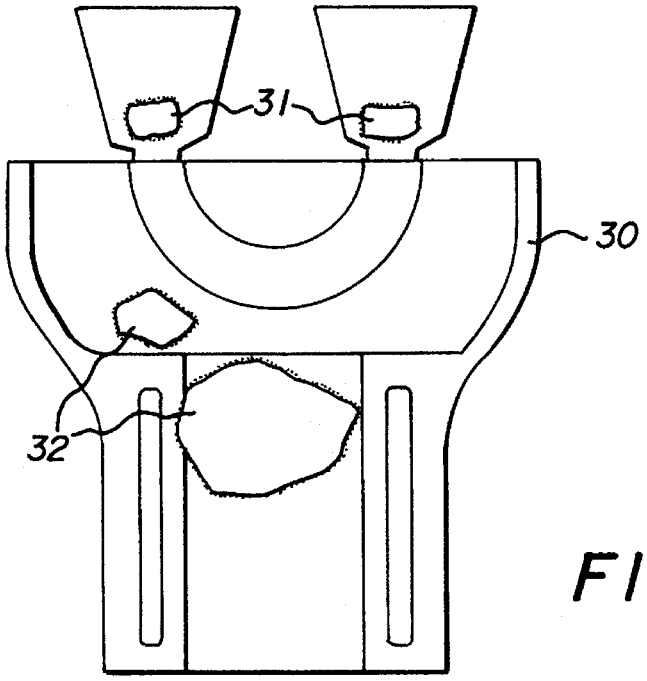
FIG. 8(*a*) is a schematic sectional view of a casting made in a cylindrical mould without positive heat extraction.
Figure 8B:
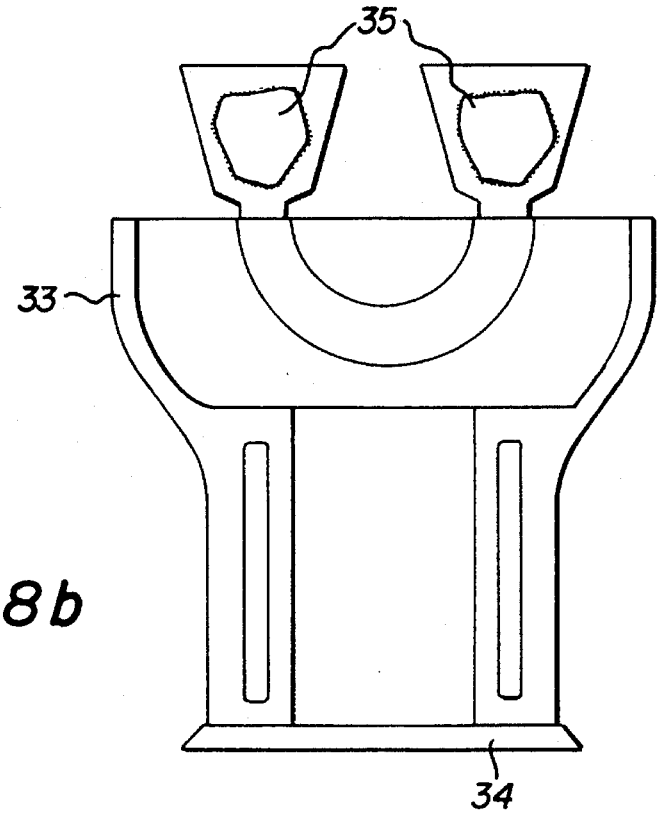

A melt of US alloy 356 (Al-7%Si-0.3% Mg) was cast into a mould assembly with and without a chill plate at the base of the mould cavity, the remainder of the mould assembly consisting of zircon sand. The mould assembly was filled via a bottom pouring system and then inverted. The beneficial effects of a large thermal extraction member at the base of mould assembly are shown in FIGS. 8(*a*) and 8(*b*).

The casting 30 produced in a mould assembly without a thermal extraction member had a moderate shrinkage cavity 31 in the runner/feeder and a larger spongy area 32 above a relatively small volume of sound (porosity free) casting. In contrast, the casting 33 (FIG. 8(*b*)) from the mould assembly with a simple heat extraction plate 34 shows a relatively larger shrinkage cavity 35 in the feeder, and a sound casting. The porosity free metal in the latter casting is due to the improved feeding as a result of the stronger directional solidification achieved by positive heat extraction from the mould assembly via the thermal extraction member.

EXAMPLE 2

To demonstrate the effect of the thermal extraction member on solidification times, graphs of metal temperature against time were produced for full sand castings and castings in accordance with the present invention (ILP). The US alloy 356 and US alloy 319 (Al-6% Si-3.5% Cu) were cast into the shape shown in FIG. 7. The results of dendrite arm spacing (DAS) measurements are given in Table 1. The castings were all made using fully degassed and cleaned metal without grain refiner additions and all samples were taken from the barrel sections of the central regions of the castings.

Figure 9A:
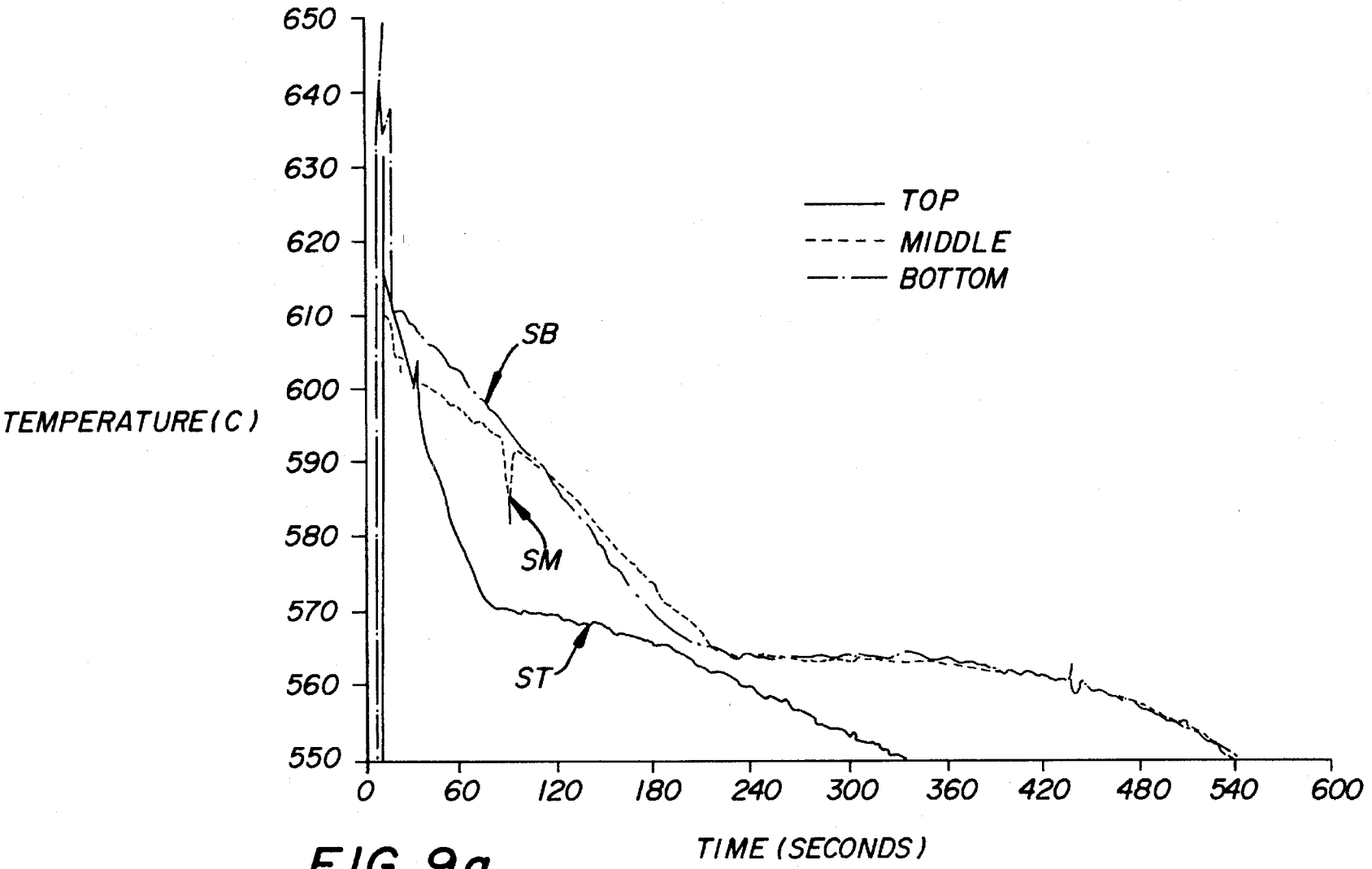
FIG. 9(*a*) is a temperature versus time cooling curve for a conventional gravity sand casting.
Figure 9B:
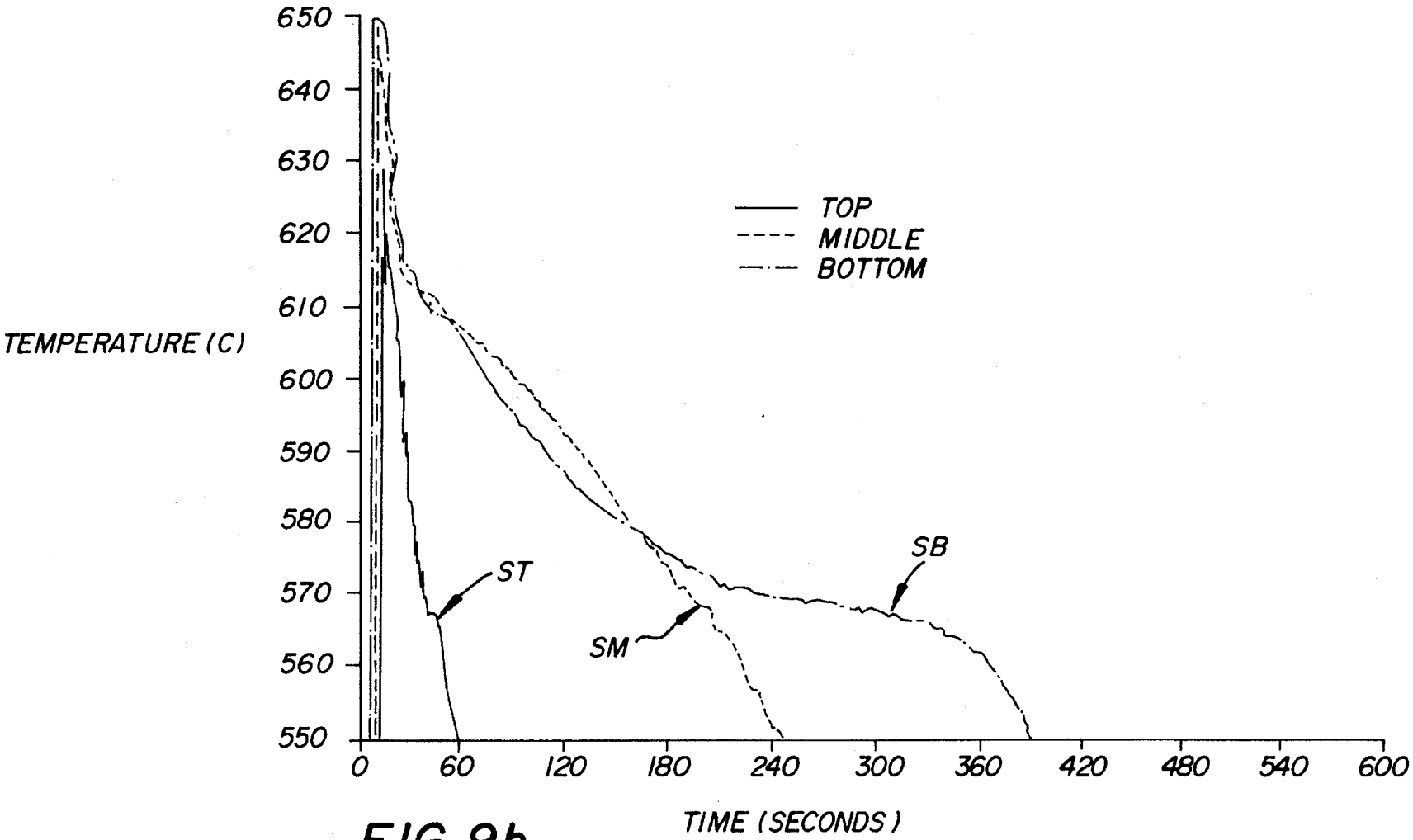

FIG. 9(*a*) is a set of cooling curves for a full sand casting while FIG. 9(*b*) is a similar set of curves but for a casting made in accordance with the Invention. It is clear that the use of the thermal extraction member has reduced the solidification time at all the measured points through the casting. The effect is most dramatic at the top of the casting adjacent to the thermal extraction member where the time to solidify shown on FIGS. 9(*a*) and 9(*b*) as point $S_T$ has been reduced from approximately 150 seconds to less than 60 seconds while in the lower sections of the casting the time to solidify ($S_M$, $S_B$) has been reduced from 390 to 200 seconds and 330 seconds, respectively.

With reduced solidification times it may be possible to increase the yield of the casting. The size of the risers feeding the casting are dictated, to a large extent; by the time taken for a casting to completely solidify. This is because the riser must remain liquid longer than the casting so that it can satisfactorily feed all shrinkage. If the time to solidify the casting can be reduced, then the riser size can similarly be reduced, resulting in a higher overall yield. Higher yields mean that less metal needs to be melted for a given number of castings, thereby reducing costs.

TABLE 1

| DENDRITE ARM SPACINGS | 356 ALLOY Barrel Wall (μm) | 319 ALLOY Barrel Wall (μm) |
|---|---|---|
| ILP | 27 | 30 |
| Low Pressure | 31 | 29 |
| Gravity Sand | 72 | 66 |

DAS values vary inversely with the solidification rate of a casting, and the above results confirm the effectiveness of the thermal extraction member in increasing the solidification rates associated with sand casting to rates approaching those found in low pressure, semi-permanent mould (SPM) casting.

DAS and grain sizes can also be an indication of the mechanical properties of a casting. Finer cast structures offer greater resistance to deformation and hence are stronger and harder. Consequently, the mechanical properties of the castings would be expected to follow the same trends as the DAS and grain size values in an inverse relationship.

EXAMPLE 3

To examine the effect of the present invention on the physical and mechanical properties of the castings, single cylinder test castings as shown in FIG. 7 using alloy 356 (Al—Si) and US alloy 319 (Al—Si—Cu) were tested. These are the two most common alloys used for gravity and low pressure casting applications and represent a wide range of casting characteristics. The mould assembly was fully assembled prior to arriving at the casting station and castings were cast in their conventional orientations.

The mechanical properties of fully heat treated castings are shown in Table 2. The samples were fully heat treated prior to testing so that the effects of any natural ageing which might have occurred were completely removed and a realistic comparison of results was ensured.

TABLE 2

| | 356 ALLOY UTS (MPa) | 319 ALLOY UTS (MPa) |
|---|---|---|
| ILP | 277 | 252 |
| Semi Permanent Mould SMP | 293 | 332 |
| Gravity Sand | 204 | 201 |

As expected, the trends found with the DAS measurements are mirrored in the mechanical properties of the castings, with strengths found in the ILP and low pressure castings considerably greater than those found in the gravity sand castings. In fact, in the case of 356 alloy, the UTS values of the ILP castings are 36% higher than those of the sand castings and are only around 5% less than those of the low pressure, semi-permanent mould castings. Even for the normally difficult to cast 319 alloy, the process of the present invention provides a 25% improvement in UTS over a conventional sand casting.

As can be shown from the examples the use of the moulds of the present invention in the process of the invention provides castings with fine structure, low porosity and excellent mechanical properties when compared with either low pressure semi-permanent mould or gravity fed sand castings. Other advantages of the present invention include high productivity, low cost and excellent dimensional control.

We claim:

1. A method of producing a metal casting in a mould assembly, comprising:

filling liquid metal from a liquid metal source upwardly through at least one primary inlet into a mould cavity defined by a mould assembly, said mould assembly having at least one thermal extraction member comprising at least one large surface area region of a high thermally conductive material, said thermal extraction member being positioned in an upper part of said mould cavity;

after filling said mould cavity with said liquid metal, inverting said mould assembly, such that said thermal extraction member is positioned in a lower part of said mould cavity;

transferring said mould assembly to a cooling station; solidifying said metal in said mould cavity, said thermal extraction member remaining in said lower part of said mould cavity during said solidifying to cause rapid and positive extraction of heat from said metal during said solidifying, such that positive heat extraction from said metal is maintained substantially for the duration of said solidifying to thereby achieve directional solidification throughout substantially all of the metal.

2. A method of producing a metal casting in a mould assembly as recited in claim 1, wherein said thermal extraction member is adjacent the bottom of the mould cavity during said solidifying.

3. A method of producing a metal casting in a mould assembly as recited in claim 1, wherein said thermal extraction member is in the bottom of said mould cavity during said solidifying.

4. A method of producing a metal casting in a mould assembly as recited in claim 1, further comprising sealing and isolating said mould assembly from said liquid metal source after filling said mould cavity with said liquid metal and before inverting said mould assembly.

5. A method of producing a metal casting in a mould assembly as recited in claim 4, wherein said sealing is accomplished by at least one sliding element, at least one electromagnetic valve or a means for freezing metal.

6. A method of producing a metal casting in a mould assembly as recited in claim 1, further comprising feeding liquid metal to said mould cavity from a feeding system during said solidifying of said metal in said mould cavity to compensate for shrinkage of metal during said solidifying.

7. A method of producing a metal casting in a mould assembly as recited in claim 6, wherein during said filling, said liquid metal is filled from said liquid metal source upwardly through said primary inlet, then through said feeding system and then into said mould cavity.

8. A method of producing a metal casting in a mould assembly as recited in claim 6, wherein said feeding system is a secondary metal cavity formed within said mould assembly.

9. A method of producing a metal casting in a mould assembly as recited in claim 6, wherein said thermal extraction member is positioned opposite said feeding system.

10. A method of producing a metal casting in a mould assembly as recited in claim 6, wherein during said filling, said feeding system and said primary inlet are both positioned below said mould cavity.

11. A method of producing a metal casting in a mould assembly as recited in claim 1, wherein said thermal extraction member and mould cavity and metal contained in the mould cavity are transferred to said cooling station before significant solidification has occurred.

12. A method of producing a metal casting in a mould assembly as recited in claim 1, wherein an external heat transfer medium or heat sink is applied to said thermal extraction member to rapidly extract heat and solidify said metal while said mould assembly is positioned at said cooling station.

13. A method of producing a metal casting in a mould assembly as recited in claim 1, wherein said directional solidification is directed toward the upper part of said mould cavity.

14. A method of producing a metal casting in a mould assembly, comprising:

filling liquid metal from a liquid metal source upwardly through at least one primary inlet into a mould cavity defined by a mould assembly, said mould assembly having at least one thermal extraction member comprising at least one large surface area region of a high thermally conductive material, said thermal extraction member being positioned in a lower part of said mould cavity;

after filling said mould cavity with said liquid metal, transferring said mould assembly to a cooling station;

solidifying said metal in said mould cavity, said thermal extraction member remaining in said lower part of said mould cavity during said solidifying to cause rapid and positive extraction of heat from said metal during said solidifying, such that positive heat extraction from said metal is maintained substantially for the duration of said solidifying to thereby achieve directional solidification throughout substantially all of the metal.

15. A method of producing a metal casting in a mould assembly as recited in claim 14, wherein said thermal extraction member is adjacent the bottom of the mould cavity during said solidifying.

16. A method of producing a metal casting in a mould assembly as recited in claim 14, wherein said thermal extraction member is in the bottom of said mould cavity during said solidifying.

17. A method of producing a metal casting in a mould assembly as recited in claim 14, further comprising sealing and isolating said mould assembly from said liquid metal source after filling said mould cavity with said liquid metal and before transferring said mould assembly to said cooling station.

18. A method of producing a metal casting in a mould assembly as recited in claim 17, wherein said sealing is accomplished by at least one sliding element, at least one electromagnetic valve or a means for freezing metal.

19. A method of producing a metal casting in a mould assembly as recited in claim 14, further comprising feeding liquid metal to said mould cavity from a feeding system during said solidifying of said metal in said mould cavity to compensate for shrinkage of metal during said solidifying.

20. A method of producing a metal casting in a mould assembly as recited in claim 19, wherein said feeding system is positioned opposite said primary inlet.

21. A method of producing a metal casting in a mould assembly as recited in claim 19, wherein said thermal extraction member is positioned opposite said feeding system.

22. A method of producing a metal casting in a mould assembly as recited in claim 19, wherein said feeding system is a secondary metal cavity formed within said mould assembly.

23. A method of producing a metal casting in a mould assembly as recited in claim 14, wherein said thermal extraction member and mould cavity and metal contained in the mould cavity are transferred to said cooling station before significant solidification has occurred.

24. A method of producing a metal casting in a mould assembly as recited in claim 14, wherein an external heat transfer medium or heat sink is applied to said thermal extraction member to rapidly extract heat and solidify said metal while said mould assembly is positioned at said cooling station.

25. A method of producing a metal casting in a mould assembly as recited in claim 14, wherein said directional solidification is directed toward the upper part of said mould cavity.

26. A method of producing a metal casting in a mould assembly comprising mould segments defining a mould cavity having at least one primary inlet below the top of the mould cavity for receiving liquid metal from a liquid metal source, said mould assembly having at least one thermal extraction member being at least one large surface area region of a high thermally conductive material positioned to cause rapid and positive extraction of heat from a solidifying casting in said mould assembly and a sealing means for sealing said mould cavity from the liquid metal source, said method comprising the steps of filling liquid metal from the liquid metal source into said mould assembly, sealing and isolating said mould assembly from said liquid metal source, removing heat from said thermal extraction member after sealing said mould cavity such that a shell of metal adjacent the thermal extraction member is solidified, and transferring at least the mould segments and metal contained therein to a cooling station, wherein said mould assembly is arranged such that positive heat extraction from said casting is maintained substantially for the duration of solidification of liquid metal in the casting to thereby achieve directional solidification throughout substantially all of the casting.

27. A method of producing a metal casting in a mould assembly as recited in claim 26, further comprising inverting said mould assembly after solidifying said shell.

28. A method of producing a metal casting in a mould assembly as recited in claim 27, wherein said thermal extraction member is in a top part of the mould cavity during said solidifying of said shell.

29. A method of producing a metal casting in a mould assembly as recited in claim 27, wherein said thermal extraction member is adjacent the top of the mould cavity during said solidifying of said shell.

30. A method of producing a metal casting in a mould assembly as recited in claim 27, wherein said thermal extraction member is in the top of said mould cavity during said solidifying of said shell.

31. A method of producing a metal casting in a mould assembly as recited in claim 27, further comprising feeding liquid metal to said mould cavity from a feeding system during said solidifying of said metal in said mould cavity to compensate for shrinkage of metal during said solidifying.

32. A method of producing a metal casting in a mould assembly as recited in claim 31 wherein during said filling, said liquid metal is filled from said liquid metal source upwardly through said primary inlet, then through said feeding system and then into said mould cavity.

33. A method of producing a metal casting in a mould assembly as recited in claim 31, wherein said thermal extraction member is positioned opposite said feeding system.

34. A method of producing a metal casting in a mould assembly as recited in claim 31, wherein during said filling, said feeding system and said primary inlet are both positioned below said mould cavity.

35. A method of producing a metal casting in a mould assembly as recited in claim 31, wherein said feeding system is a secondary metal cavity formed within said mould assembly.

36. A method of producing a metal casting in a mould assembly as recited in claim 27, wherein said thermal extraction member is positioned opposite said primary inlet.

37. A method of producing a metal casting in a mould assembly as recited in claim 26, wherein the orientation of said mould assembly when in said cooling station is the same as the orientation of said mould assembly during said filling.

38. A method of producing a metal casting in a mould assembly as recited in claim 37, wherein said thermal extraction member is in a bottom part of said mould cavity during said solidifying of said shell.

39. A method of producing a metal casting in a mould assembly as recited in claim 37, wherein said thermal extraction member is adjacent the bottom of the mould cavity during said solidifying of said shell.

40. A method of producing a metal casting in a mould assembly as recited in claim 37, wherein said thermal extraction member is in the bottom of said mould cavity during said solidifying of said shell.

41. A method of producing a metal casting in a mould assembly as recited in claim 37, further comprising feeding liquid metal to said mould cavity from a feeding system during said solidifying of said metal in said mould cavity to compensate for shrinkage of metal during said solidifying.

42. A method of producing a metal casting in a mould assembly as recited in claim 41, wherein said feeding system is positioned opposite said primary inlet.

43. A method of producing a metal casting in a mould assembly as recited in claim 41, wherein said thermal extraction member is positioned opposite said feeding system.

44. A method of producing a metal casting in a mould assembly as recited in claim 41, wherein said feeding system is a secondary metal cavity formed within said mould assembly.

45. A method of producing a metal casting in a mould assembly as recited in claim 26, wherein an external heat transfer medium or heat sink is applied to said shell to rapidly extract heat and solidify said metal while said mould assembly is positioned at said cooling station.

46. A method of producing a metal casting in a mould assembly as recited in claim 26, wherein said sealing is accomplished by at least one sliding element, at least one electromagnetic valve or a means for freezing metal.

47. A method of producing a metal casting in a mould assembly as recited in claim 26, wherein after said transferring at least the mould segments and metal contained therein to a cooling station, said directional solidification is directed upwardly.

* * * * *